US010148030B2

(12) United States Patent
Krech

(10) Patent No.: US 10,148,030 B2
(45) Date of Patent: Dec. 4, 2018

(54) INSULATING BODY FOR AN ELECTRICAL PLUG CONNECTION UNIT

(71) Applicant: Lapp Engineering & Co., Cham (CH)

(72) Inventor: Johann Krech, Horb am Neckar (DE)

(73) Assignee: LAPP ENGINEERING & CO., Cham (CH)

( * ) Notice: Subject to any disclaimer, the term of this patent is extended or adjusted under 35 U.S.C. 154(b) by 0 days.

(21) Appl. No.: 15/906,749

(22) Filed: Feb. 27, 2018

(65) Prior Publication Data

US 2018/0294597 A1 Oct. 11, 2018

(30) Foreign Application Priority Data

Apr. 7, 2017 (EP) ..... 17165396

(51) Int. Cl.

| | |
|---|---|
| ***H01R 13/42*** | (2006.01) |
| ***H01R 4/48*** | (2006.01) |
| ***H01R 9/24*** | (2006.01) |
| ***H01R 13/53*** | (2006.01) |
| ***H01R 43/18*** | (2006.01) |
| ***H01R 13/512*** | (2006.01) |
| ***H01R 13/516*** | (2006.01) |
| *H01R 13/50* | (2006.01) |
| *H01R 4/36* | (2006.01) |
| *H01R 13/04* | (2006.01) |
| *H01R 13/10* | (2006.01) |

(52) U.S. Cl.

CPC ..... *H01R 13/42* (2013.01); *H01R 4/489* (2013.01); *H01R 9/2408* (2013.01); *H01R 13/512* (2013.01); *H01R 13/516* (2013.01); *H01R 13/53* (2013.01); *H01R 43/18* (2013.01); *H01R 4/36* (2013.01); *H01R 4/366* (2013.01); *H01R 4/4818* (2013.01); *H01R 13/04* (2013.01); *H01R 13/10* (2013.01); *H01R 13/50* (2013.01)

(58) Field of Classification Search

CPC ..... H01R 13/42

See application file for complete search history.

(56) References Cited

U.S. PATENT DOCUMENTS 5,577,933 A * 11/1996 Robinson ..... G01R 11/04 439/508

5,727,314 A * 3/1998 Ashcraft ..... H01R 4/36 29/884

(Continued)

FOREIGN PATENT DOCUMENTS

EP 2 034 562 B1 10/2013

*Primary Examiner* — James Harvey

(74) *Attorney, Agent, or Firm* — Nixon & Vanderhye P.C.

(57) ABSTRACT

An insulation body for an electrical connector unit includes at least two insertion channels into each of which a contact pin or a contact bush can be inserted, which preferably are aligned parallel to a main axis of the insulating body into which a securing channel empties, preferably perpendicular to it, in which a set screw is supported so as to turn, by means of which the related contact pin or the related contact bush can be mechanically impinged on, and to which an insulating collar is assigned, which is arranged on the outer side of the insulating body, at least approximately coaxial to the related securing channel. Preferably each of the insulating collars has at least one collar opening that is limited on both sides by collar ends.

17 Claims, 7 Drawing Sheets

(56) References Cited

U.S. PATENT DOCUMENTS

| | | | | |
|---|---|---|---|---|
| 2009/0068894 | A1* | 3/2009 | Ohashi | H01R 11/12<br>439/620.26 |
| 2009/0311897 | A1* | 12/2009 | Moist | H01R 4/36<br>439/271 |
| 2011/0189901 | A1* | 8/2011 | Lopez | H01R 4/36<br>439/814 |

* cited by examiner

INSULATING BODY FOR AN ELECTRICAL PLUG CONNECTION UNIT

This application claims priority to EP 17165396.7 filed Apr. 7, 2017, the entire contents of which are hereby incorporated by reference.

TECHNICAL FIELD

The invention relates to an insulating body for a connector unit, a connector unit with such an insulating body, a plug-and-socket connector with such a connector unit and a method for manufacturing such an insulating body.

BACKGROUND OF THE INVENTION

Plug-and-socket connectors, which comprise two connector units that are complementary to one another, serve for connecting and disconnecting electrical lines and electrical devices. Normally, connector units include a plurality of contact pins or contact bushes, which are isolated vis-à-vis each other and connected by electrical lines.

From prior art, various plug-and-socket connectors are known, which are particularly suitable for applications in mechanical engineering, in electrical switch cabinets or in applications with more stringent requirements regarding mechanical or chemical robustness. To ensure meeting the requirements regarding robustness, the plug-and-socket connectors are designed with massive housings, which results in very large needs for space. The size of the housing is further influenced by the interior insulating body as well as the elements necessary for securing the insulating body on the housing.

From EP2034562B1, a plug-and-socket connector is known with a one-piece insulating body. On the outer side, the insulating body has densely packed, slender structures, which ensure insulation between adjoining contacts. Between the slender structures, dirt particles regularly accumulate, via which leakage currents can flow, so that the insulating properties of the plug-and-socket connector are impaired.

SUMMARY OF THE INVENTION

Based on the foregoing, the primary object of the present invention is creating an improved insulating body for connector units and to connector units and plug-and-socket connector units equipped with this insulating body. The invention relates further to a method for manufacturing such an insulating body.

Especially the insulating body should be able to admit and guide a plurality of electrical contacts electrically insulated against each other.

Additionally, the insulating body should have a compact design and be suitable for rated voltages of at least 400V. The insulating body should be able to accommodate contact pins and contact bushes having increased density, without the appearance of leakage currents.

Additionally, the structures should be designed on the outside of the insulating body, so that despite contamination by deposited particles, a sufficiently large leakage path exists as a minimum leakage segment (as per IEC 60664-1) between two adjoining conducting elements.

In addition, a method should be indicated for manufacture of such an insulating body. Additionally, male and female plug-and-socket connector units should be created which are equipped with an inventive insulating body and can be combined into a plug-and-socket connector.

The novel features believed characteristic of the invention, i.e. of the inventive insulating body, the connector unit, the plug-and-socket connector unit and the inventive method, are set forth in the appended claims.

The insulating body, which is suitable for use in an electrical plug-and-socket unit, comprises at least two, preferably a plurality of insertion channels, for receiving contact pins or contact bushes. The insertion channels preferably are aligned along a principal axis of the insulating body, to make possible a compact design. Into the insertion channels, bared cable ends are insertable and able to be secured in the contact pins or contact bushes. Additionally, the insulating body has at least two, and preferably a plurality of securing channels, which are aligned at least approximately perpendicular to the insertion channels. To each insertion channel a securing channel is assigned, so that the set screw inserted into the securing channel can impinge mechanically on the contact pin or contact bush supported in the insertion channel. On the outer side of the insulating body, at least approximately aligned coaxial to the fixing channel, at least two, and preferably a plurality of insulating collars are shaped. The insulating collars ensure lateral electrical insulation of the set screws electrically connected with the contact pins or contact bushes.

According to the invention, the insulating collars each have a collar opening, which is limited on both sides by collar ends. Through the collar openings, the distance between the slender insulating collars is increased, so that small dirt particles no longer can stay stuck between the insulating collars. Deposited dirt particles can cause leakage currents on insulating bodies, which lead to a failure of the insulating body and the plug-and-socket connector connected therewith, since electrical insulation no longer can be ensured. The leakage segment along the surface of the of the insulating body is increased according to the invention by the collar openings, so that operational safety of the insulating body is improved, or also the attachment contacts can be designed with greater density.

In one preferred embodiment, the insulating collars are configured as segments of hollow cylinders, which lack a hollow cylinder segment at the collar ends. Preferably the collar ends form edges that are aligned parallel to one another, which limit the collar opening. This geometric shape makes it possible to simplify manufacture.

In a further preferred embodiment, on the outer side of the insulating body, an insulating wall is shaped for electrical insulation of the adjoining set screws in regard to leakage currents. The leakage currents can flow along the surface of the set screws to a protective conductor and/or to a plug-and-socket connector housing and/or to the holding devices. Through the insulating wall, the leakage path is enlarged and the leakage currents correspondingly reduced.

In an especially preferred embodiment, the collar openings in the insulating collars are aligned against the adjoining insulation collar or against the insulating wall. By this means the space between adjoining insulating walls at the narrowest point is increased, due to which smaller particles no longer can be mechanically blocked. The adjoining insulation collars are preferably aligned in a row, with the collar openings at least approximately pointing in the same direction and having a common opening axis.

Preferably the insulating collars have a wall thickness of 0.4 to 1.5 mm. In an especially preferred embodiment, the insulating collars have a wall thickness between 0.75 mm and 1.0 mm.

In an especially preferred embodiment of the insulating body, on the inner side of the insulating collar, on the inner side of the securing channels, one or more blocking ribs are shaped for mechanical blocking of the set screws. The blocking ribs prevent an undesired loosening or falling out of the set screws, through vibrations for example.

Preferably the collar openings have an opening width of 1.0 to 8.0 mm. In an especially preferred embodiment, the collar openings have an opening width between 1.5 mm and 3.0 mm. Preferably the collar openings have an opening angle relative to the central axis of the insulating collar of between 60° and 120°. Especially preferred, the opening angle is in the range between 90° plus or minus 5°.

In a further preferred embodiment, the surface of the insulating body has dirt-deflecting and/or self-cleaning properties. Preferably this property is attained by a coating which is dirt-deflecting and/or self-cleaning. Through the dirt-deflecting and/or self-cleaning surface, deposition of dirt particles on the insulating body is additionally reduced.

Preferably the material for the insulating body, or, as the case may be, for the coating of the insulating body, has high leakage current resistance, so that the insulating body can be assigned to a better insulator group as per IEC 60664-1.

The insulation distance between a set screw and the adjoining insulating collar preferably is in a range between 0.75 mm-1.25 mm, especially preferred at 1 mm. These values can be appropriately adjusted in dependence on the environmental conditions in which the inventive plug-and-socket connectors are used.

In another preferred embodiment, on at least two opposite sides of the insulating body, locking projections and fixing means guides can be provided for mechanical attachment of fixing means. By means of the fixing means, the insulating body can be attached and/or secured in a housing of a plug-and-socket connector.

Preferably the insulating body is suitable for rated voltages of at least 400V. Especially preferred, despite the particles deposited on the insulated body by contamination, only short leakage segments as per the IEC standard 60664-1 are created, so that during the service life of the insulating body, no electrical flashovers occur.

In a preferred embodiment, on the insulating body, coding elements, preferably coding ribs or coding grooves, are shaped. The coding elements ensure correct plug-and-socket connection.

With an inventive insulating body, inventive plug-and-socket connector units can be implemented in advantageous fashion. The plug-and-socket connector comprises two plug-and-socket connector units, with one plug-and-socket connector unit being configured as female or male plug-and-socket connector halves. Preferably both plug-and-socket connector units each include an inventive insulating body.

An inventive insulating body preferably is likewise manufactured by an inventive method. The method is preferably a master-pattern method, especially a casting method, a die-casting method or an injection-molding method. Alternatively, a 3D casting method can be used. Preferably the method includes at least one materials-removal procedural step. In an especially preferred embodiment of the method, during the materials-removal procedural step, the collar openings on the insulating collars are configured.

BRIEF DESCRIPTION OF THE DRAWINGS

The invention, as well as a preferred mode of use, further objectives and advantages thereof, will best be understood by reference to the following detailed description of the illustrative embodiments when read in conjunction with the accompanying drawings, wherein.

DETAILED DESCRIPTION

Figures 1A, 1B:
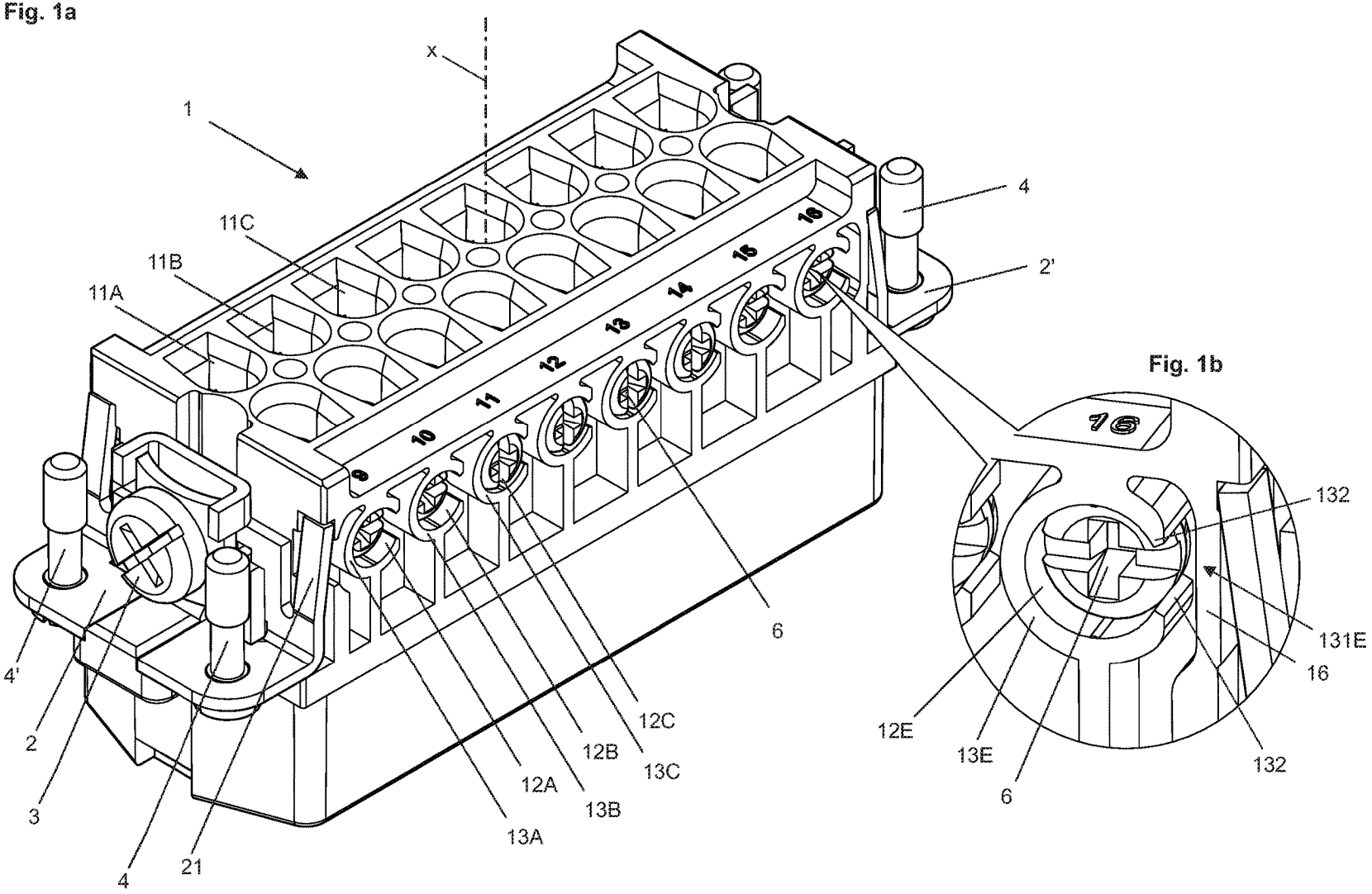
FIG. 1*a* shows an inventive insulating body 1 with securing means 2, 2'.
FIG. 1*b* shows a detail view of insulating body 1 of FIG. 1*a;*

FIG. 1*a* shows an inventive insulating body 1 with holding means 2, 2' in a perspective view. Insulating body 1 has multiple insertion channels 11A, 11B, 11C, . . . , running through insulating body 1, which admit contact pins or contact bushes not shown. To each insertion channel 11A, 11B, 11C, . . . , laterally a securing channel 12A, 12B, 12C, . . . is assigned, into which a set screw 6 can be inserted. On securing channels 12A, 12B, 12C, . . . insulating collars 13A, 13B, 13C, . . . are arranged, which provide lateral electrical insulation to set screw 6 arranged in the pertinent securing channel 12A, 12B, 12C, . . . . At two ends of insulating body 1, holding means 2, 2' are shown, by which insulating body 1 with coupling means 4, 4' is able to be secured in a housing of a plug-and-socket connector. Holding means 2, 2' comprise locking elements 21 and at least one set screw 3 for securing on insulating body 1. Set screw 3 can simultaneously assume the function of the protective line contact. In this version, the holding means 2, 2' are configured as protective line plates.

FIG. 1*b* shows a close-up view of insulating body 1 from FIG. 1*a*. On securing channel 12E, an insulating collar 13E is shaped concentrically, which is configured as a hollow cylinder, so that insulating collar 13E has two collar ends 132, which border a collar opening 131E. Collar opening 131E, which for example is a result of cutting through insulating collar 13E, preferably has a rectangular cross section. Into securing channel 12E, a set screw 6 is inserted, which can be turned against the contact element, the contact pin, or the contact bush.

Figure 2:
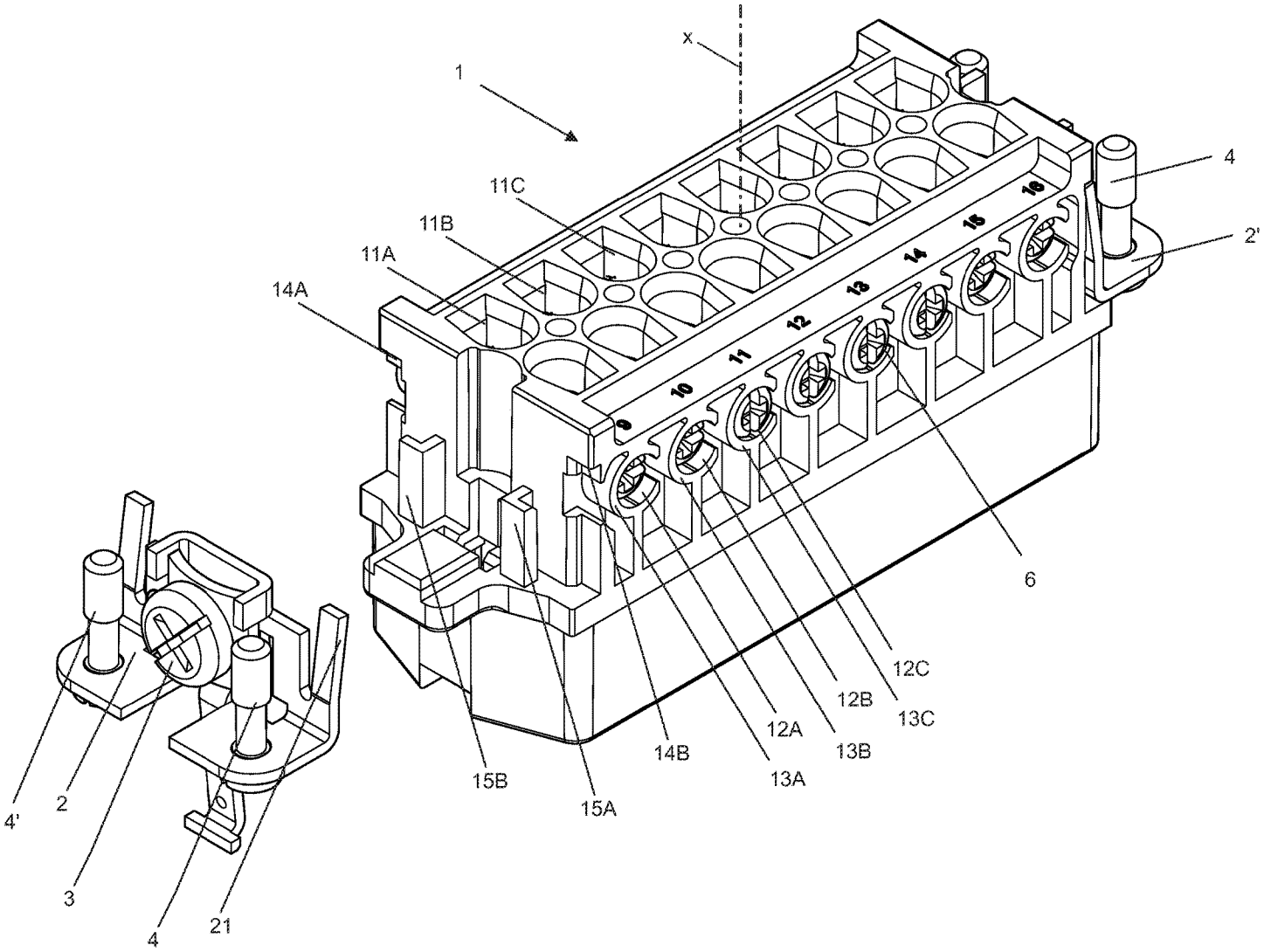
FIG. 2 shows the insulating body 1 of FIG. 1*a* in another view with securing means 2 depicted in exploded fashion.

FIG. 2 shows insulating body 1 from FIG. 1*a* in another view with holding means 2 depicted in exploded fashion. On insulating body 1, locking projections 14A, 14B and holding means guides 15A, 15B are shaped, into which corresponding elements of holding means 2 can engage.

Figure 3:
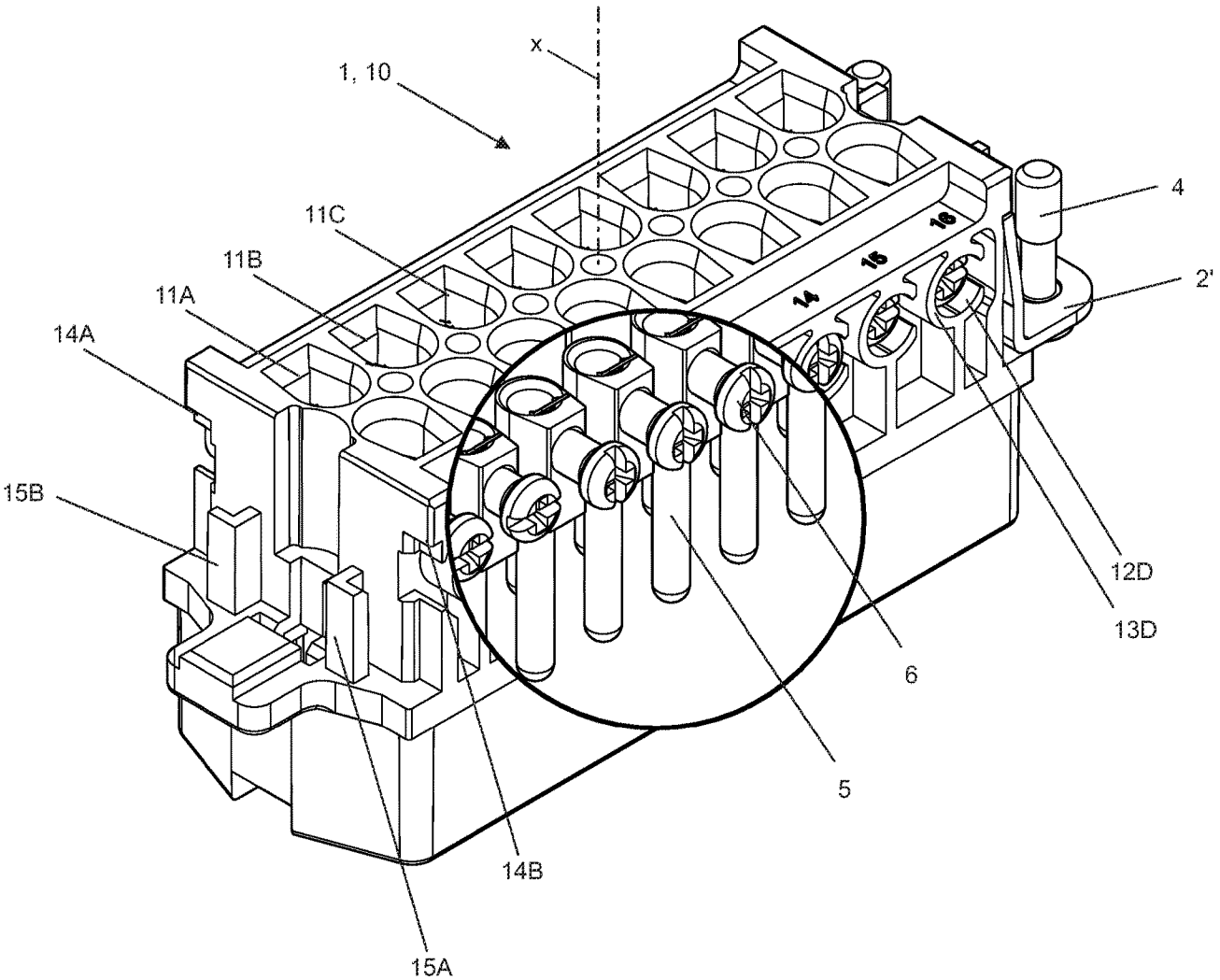
FIG. 3 shows a plug-and-socket connector unit 10 having an insulating body 1 from FIG. 1*a* equipped with contact pins 5 with a circular view for emphasis of the interior of insulating body 1.

FIG. 3 shows insulating body 1 from FIG. 1*a* with a circular enlargement emphasizing the interior of insulating body 1. In insertion channels 11A, 11B, 11C, contact pins 5 are arranged, into which an electric line can be secured by set screw 6.

Figure 4:
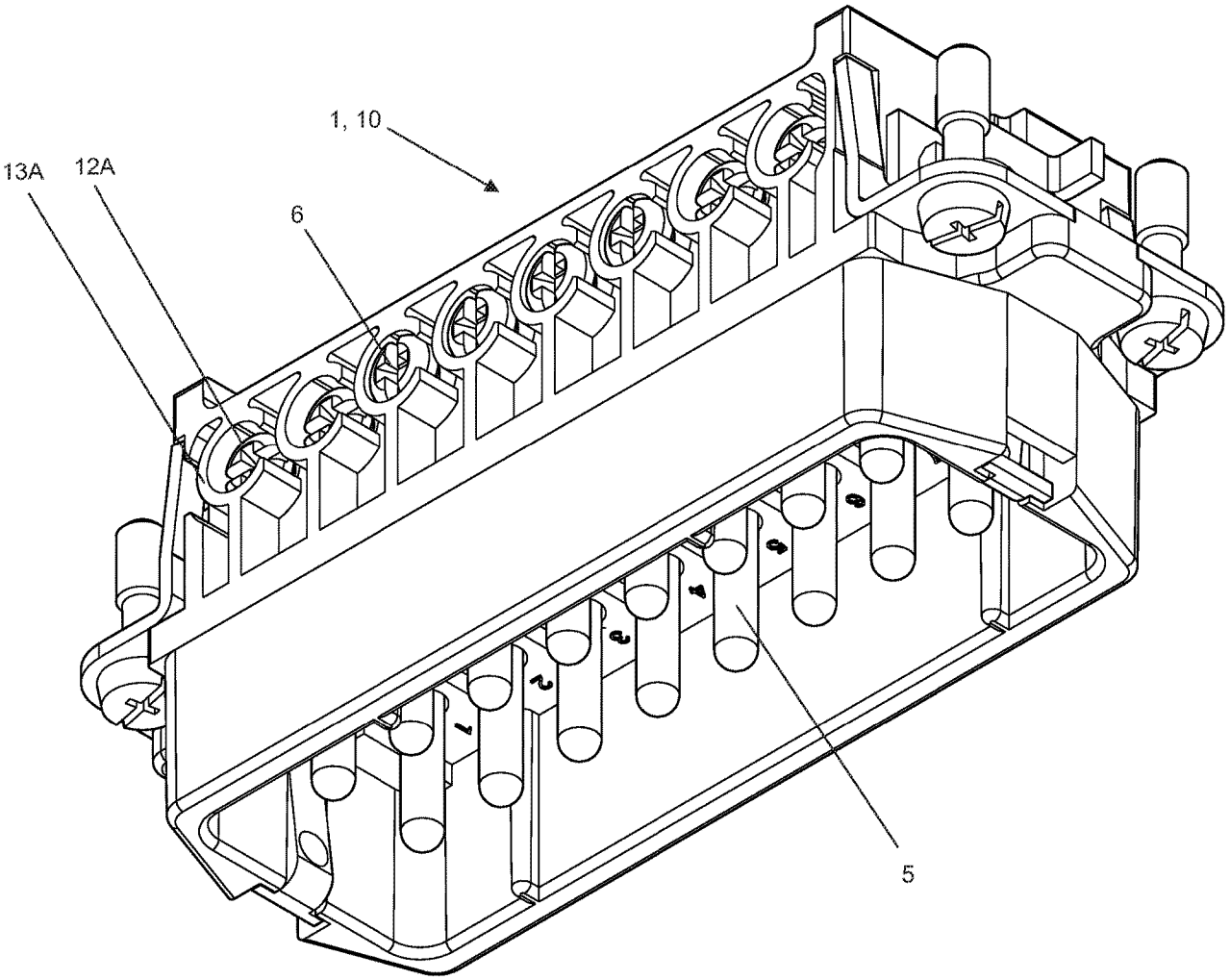
FIG. 4 shows plug-and-socket connection unit 10 of FIG. 1*a* in a further view.

FIG. 4 shows insulating body 1 from FIG. 1*a* in another view. The contact pins 5 project out from insulating body 1, so that they engage into a complementary plug-and-socket connection half and can create an electrical contact. Coding ribs 17 are shaped on the insulating body, which can engage into corresponding coding elements on an opposite piece. The coding elements prevent two insulating bodies 1 from being joined in a wrong position.

Figures 5A, 5B:
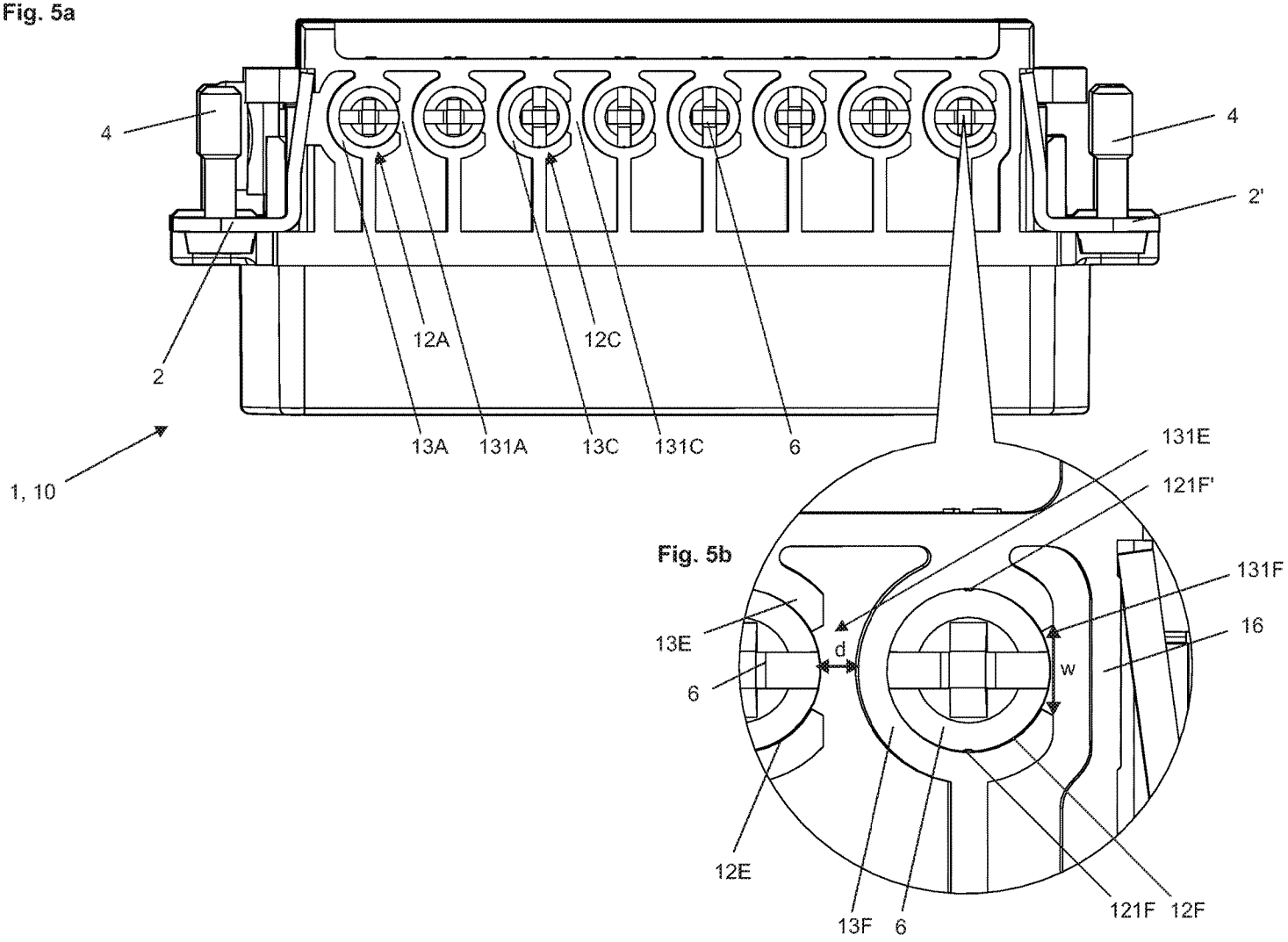
FIG. 5*a* shows insulating body 1 of FIG. 1*a* in a side view.
FIG. 5*b* shows a detail view of insulating body 1 from FIG. 5*a;*

FIG. 5*a* is a side view of insulating body 1 from FIG. 1*a*. Securing channels 12A, 12B, 12C, . . . , are shown arranged in a row in the preferred embodiment shown. Insulating collars 13A, 13B, 13C, . . . , are arranged concentrically to securing channels 12A, 12B, 13C, . . . . Insulating collars 13A, 13B, 13C have collar openings 131A, 131B, 131C, . . . , each of which faces in the direction of adjoining insulating collar 13A, 13B, 13C.

FIG. 5*b* is a close-up view of insulating body 1 from FIG. 5*a*. Insulating collar 13E has a collar opening 131E, which points in the direction of adjoining insulating collar 13F. The insulation distance d designates the distance between electrically conducting set screw 6 in securing channel 12E and adjoining insulating collar 13F, which insulates the adjoining set screw. Collar opening 131F in insulating collar 13F has an opening width w. Adjoining to insulation collar 13F, an insulating wall 16 is arranged, through which the lateral electrical insulation vis-à-vis holding means 2, 2' and the elements attached thereon is assured. On the inner side of securing channel 12F, two opposing blockading ribs 121F, 121F' are shaped. Blockading ribs 121F, 121F' prevent set screws 6 from coming loose due to vibrations or other motions of insulating body 1.

Figure 6:
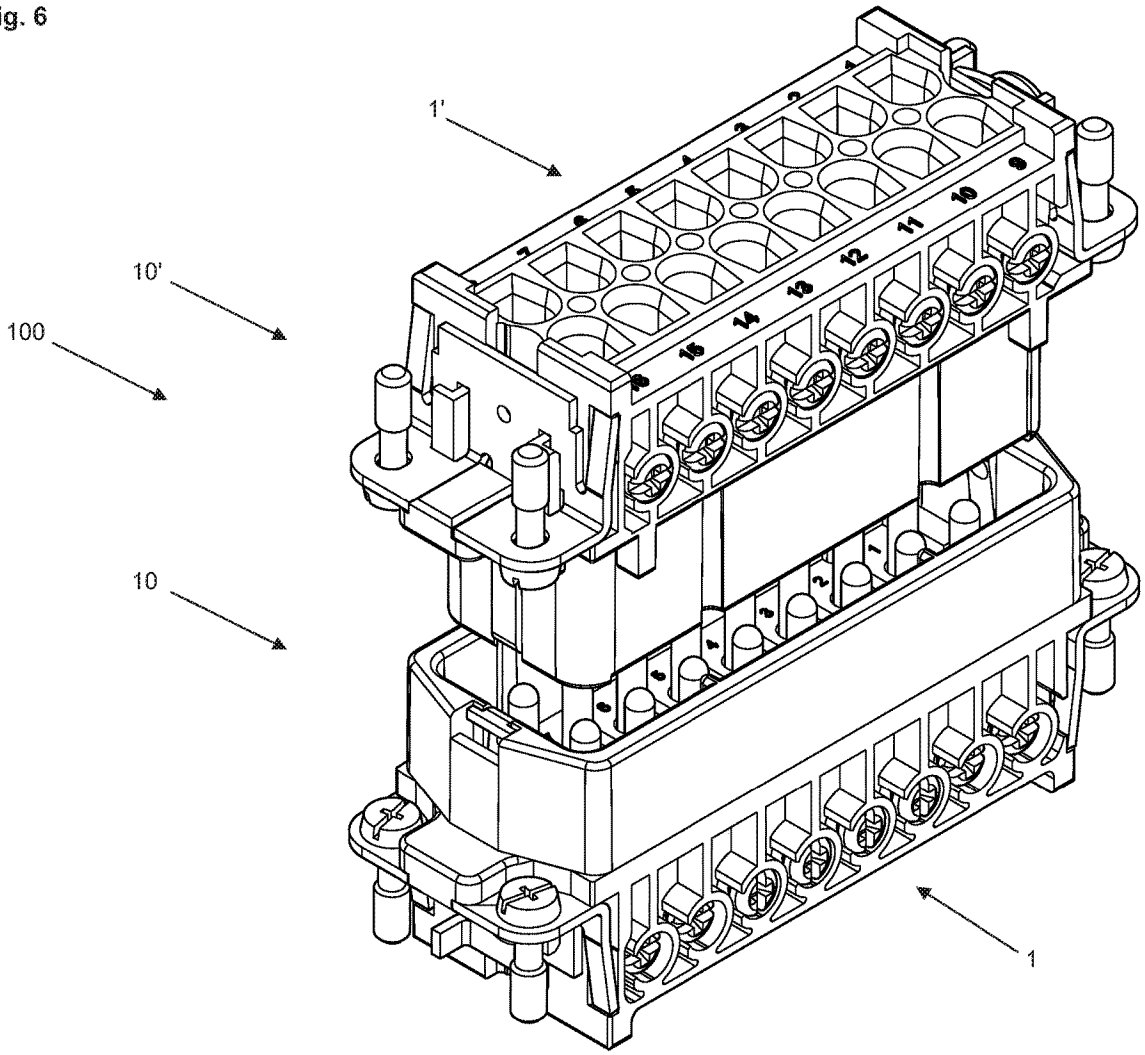
FIG. 6 shows a plug-and-socket connector 100 with two plug-and-socket connector units 10, 10' which have insulating bodies 1, 1' configured to be complementary to one another.

FIG. 6 shows a plug-and-socket connector 100 with plug-and-socket connector units 10, 10', which have insulating bodies 1, 1' complementary to one another. Plug-and-socket connector units 10, 10' can include a housing not shown here. The second insulating body 1' has coding grooves 18, which are formed out complementary to the coding elements on insulating body 1.

Figure 7:
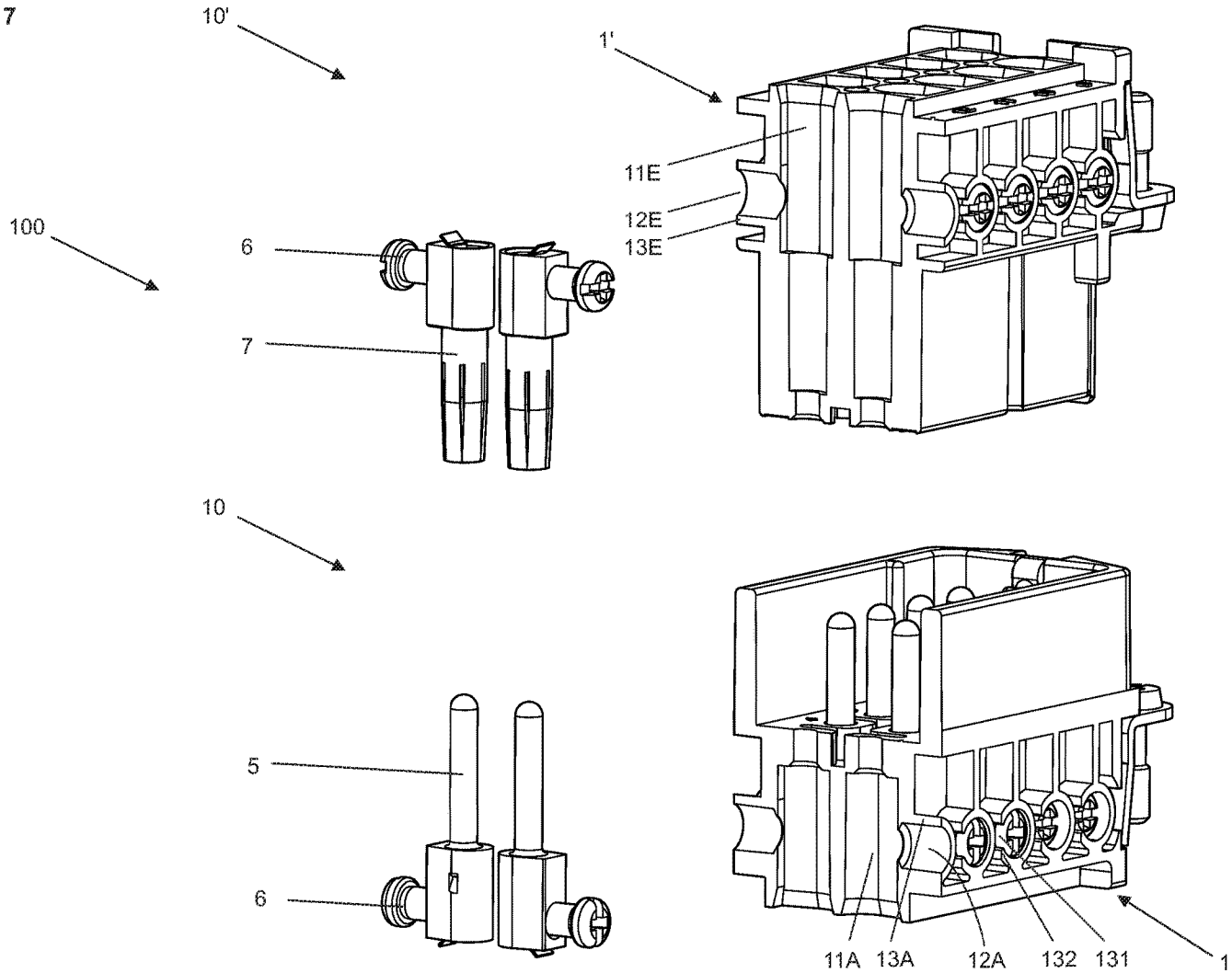
FIG. 7 shows plug-and-socket connector 100 of FIG. 6 in a partially cut-away view with contact pins 5 and contact bushes 7 shown in exploded fashion.

FIG. 7 shows plug-and-socket connector 100 from FIG. 6 in a partially cut-away view, with contact pins 5 and contact bushes 7 depicted in exploded views. In the lower insulating body 1, contact pins 5 are arranged in insertion channels 11A. In the upper insulating body 1', contact bushes 7 are arranged complementary thereto in insertion channels 11E. Contact pins 5 and contact bushes 7 are able to be mechanically impinged on via set screws 6. Set screws 6 are guided to securing channels 12A, 12E, which are surrounded by an insulating collar 13A, 13E. It is shown that securing channels 12A; 12E are aligned perpendicular to insertion channels 11A; 11E and surrounded by hollow cylindrical insulating collars 13A; 13E. Insulating collars 13A; 13E are shaped as a single piece on insulating body 1, 1' and directed outward, so that they project outward over insulating body 1, 1'. Insertion channels 11 in this preferred embodiment are arranged in two rows, with every two securing channels 12 lying coaxially opposite.

LIST OF REFERENCE SYMBOLS

1, 1' insulating body
11A, 11B, 11C, . . . insertion channel
12A, 12B, 12C, . . . securing channel
121F, 121F' blocking rib
13A, 13B, 13C, . . . insulating collar
131A, 131B, 131C, . . . collar openings
132 collar ends
14A, 14B locking projection
15A, 15B holding means guide
16 insulating wall
17 coding rib
18 coding groove
2, 2' holding means
21 locking element
3 set screw
4, 4' coupling means
5 contact pin
6 clamping screw
7 contact bush
d insulation distance
w opening width

The invention claimed is:

1. An insulating body for an electrical connector unit comprising a plurality of insertion channels;

the insertion channels are designed each for receiving a contact pin or a contact bush, the insertion channels are laterally adjoined each by a securing channel, in which securing channel a set screw is held that can be screwed with a front end into the related insertion channel to mechanically fix the related contact pin or the related contact bush, and the insertion channels at one end are adjoined each by an insulating collar, which is arranged on the outer side of the insulating body aligned at least approximately coaxial to the related insertion channels, wherein at least one or all of the insulating collars have at least one collar opening that is limited on both sides by collar ends.

2. The insulating body of claim 1, wherein the insulating collar is configured as a hollow cylinder element with the collar ends forming edges aligned in parallel to one another.

3. The insulating body of claim 1, wherein on the outer side of the insulating body an insulating wall is provided for electrical insulation of at least one of the set screws.

4. The insulating body of claim 1, wherein each collar opening is facing the adjoining insulation collar or the insulating wall, or that the insulation collars are aligned in a row and the collar openings have a common opening axis.

5. The insulating body of claim 1, wherein the insulating collars have a wall thickness of 0.4 mm to 1.5 mm, preferably of 0.75 mm to 1 mm.

6. The insulating body of claim 1, wherein on the inner side of each insulation collar or on the inner side of each securing channel one or more blocking ribs are provided for mechanically blocking the received set screw.

7. The insulating body of claim 1, wherein the collar openings have an opening width between 1 mm and 8 mm, preferably between 1.5 mm and 3 mm.

8. The insulating body of claim 1, wherein the collar openings have an opening angle in a range between 60° and 120°, preferably approximately 90°.

9. The insulating body of claim 1, wherein the surface of the insulating body has dirt-deflecting or self-cleaning properties.

10. The insulating body of claim 1, wherein the insulating distance between each set screw and the adjoining insulation collar or the insulating wall is at least 1 mm.

11. The insulating body of claim 1, wherein on at least two opposite sides of the insulating body, locking projections and holding means guides are arranged for mechanically securing holding means, with which the insulating body is fixable within a housing of a connector unit.

12. The insulating body of claim 1, wherein the insulating body is designed for rated voltages of at least 400 V.

13. The insulating body of claim 1, wherein the insulating body is designed such that particles deposited by contamination on the insulating body do not cause leakage segments that are shorter than the shortest leakage segment allowed by the applicable standard.

14. A connector unit with an insulating body according to claim 1, which is equipped with contact pins or contact bushes.

15. A socket-and-plug connector unit with a connector unit according to claim 14, which is equipped with contact pins, and which is equipped with bushes.

16. A method for manufacturing an insulating body of claim 1, wherein the insulating body is manufactured by a master-pattern method, especially by casting, 3D-casting, die-casting or injection-molding.

17. The method according to claim 16 including at least one materials-removal procedural step, for configuring the collar openings, on the insulating collars.

* * * * *